US009089473B2

(12) United States Patent
Frabetti et al.

(10) Patent No.: US 9,089,473 B2
(45) Date of Patent: Jul. 28, 2015

(54) FEEDING ASSEMBLY FOR METERING TABLETS INTO CAPSULES

(75) Inventors: Davide Frabetti, Baricella (IT); Ernesto Gamberini, Rastignano (IT)

(73) Assignee: MG 2- S.R.L., Pianoro (IT)

( * ) Notice: Subject to any disclaimer, the term of this patent is extended or adjusted under 35 U.S.C. 154(b) by 893 days.

(21) Appl. No.: 13/378,119

(22) PCT Filed: Jun. 15, 2010

(86) PCT No.: PCT/IB2010/001452
§ 371 (c)(1),
(2), (4) Date: Apr. 2, 2012

(87) PCT Pub. No.: WO2010/146445
PCT Pub. Date: Dec. 23, 2010

(65) Prior Publication Data

US 2012/0186193 A1 Jul. 26, 2012

(30) Foreign Application Priority Data

Jun. 16, 2009 (IT) ..... B02009A0388

(51) Int. Cl.
*B65B 1/00* (2006.01)
*A61J 3/07* (2006.01)
*B65B 35/08* (2006.01)

(52) U.S. Cl.
CPC ..... *A61J 3/074* (2013.01); *B65B 35/08* (2013.01); *B65B 2210/10* (2013.01)

(58) Field of Classification Search
CPC ..... A61J 3/07; A61J 3/071; A61J 3/074; A61J 3/072
USPC ..... 53/900, 281, 282, 500, 473, 253
See application file for complete search history.

(56) References Cited

U.S. PATENT DOCUMENTS

| | | | | |
|---|---|---|---|---|
| 4,615,165 | A * | 10/1986 | Gamberini | 53/282 |
| 5,320,146 | A * | 6/1994 | Stevie | 141/1 |
| 6,311,743 | B1 * | 11/2001 | Baroncini | 141/234 |
| 6,435,230 | B2 * | 8/2002 | Wurst et al. | 141/239 |
| 6,814,111 | B1 * | 11/2004 | Oliverio et al. | 141/237 |
| 6,901,972 | B1 * | 6/2005 | Nelson | 141/67 |
| 7,392,640 | B2 * | 7/2008 | Vasquali | 53/498 |
| 7,726,101 | B2 * | 6/2010 | Frabetti | 53/471 |
| 7,954,307 | B2 * | 6/2011 | Paunesku et al. | 53/459 |
| 8,479,476 | B2 * | 7/2013 | Baroncini | 53/246 |
| 2002/0002809 | A1 * | 1/2002 | Wurst et al. | 53/247 |
| 2005/0217208 | A1 * | 10/2005 | Cicognani | 53/54 |
| 2007/0028560 | A1 * | 2/2007 | Gauthier | 53/167 |
| 2007/0044433 | A1 * | 3/2007 | Runft et al. | 53/281 |
| 2008/0236106 | A1 * | 10/2008 | Trebbi et al. | 53/471 |
| 2008/0256908 | A1 * | 10/2008 | Frabetti | 53/502 |
| 2011/0030314 | A1 * | 2/2011 | Baroncini | 53/254 |

FOREIGN PATENT DOCUMENTS

| | | |
|---|---|---|
| DE | 10027008 | 12/2001 |
| EP | 1982687 | 10/2008 |

* cited by examiner

*Primary Examiner* — Andrew M Tecco
(74) *Attorney, Agent, or Firm* — Gottlieb, Rackman & Reisman, P.C.

(57) ABSTRACT

A feeding assembly for metering tablets into capsules is provided, wherein a given number of tablets are first loaded into relative metering holes in a dispenser plate mounted to rotate about a longitudinal axis tilted with respect to a vertical direction, and are then unloaded into the bottom shell of a capsule from a feed channel formed through a vibrating feed disk mounted to rotate about a substantially vertical longitudinal axis.

16 Claims, 7 Drawing Sheets

FEEDING ASSEMBLY FOR METERING TABLETS INTO CAPSULES

This application is the U.S. National Phase application of PCT/IB2010/001452 filed on Jun. 15, 2010, which claims priority from Italian application no. BO2009A000388 filed Jun. 16, 2009.

TECHNICAL FIELD

The present invention relates to a feed assembly for metering tablets into capsules.

BACKGROUND ART

In the pharmaceutical industry, a feed assembly is known comprising a metering station for feeding a given number of tablets into the bottom shell of a capsule; a dispenser plate mounted to rotate about a first longitudinal axis at an angle of other than zero with respect to a substantially vertical direction, and having at least one set of metering holes, each of which houses at least one tablet and is fed by the dispenser plate through the metering station; a fixed annular plate mounted beneath the dispenser plate to normally close the metering holes, and having an opening at the metering station; and a feed disk mounted beneath the dispenser plate to rotate about a substantially vertical second longitudinal axis, and comprising, for each set of metering holes, a feed channel along which the relative tablets are fed into a relative bottom shell.

Given the relatively large number of metering holes in each set, and the fact that each metering hole may be designed to house even more than one tablet, known feed assemblies of the above type have various drawbacks, mainly due to each feed channel receiving a relatively large number of tablets simultaneously at the metering station, and so becoming clogged.

DISCLOSURE OF INVENTION

It is an object of the present invention to provide a feed assembly for metering tablets into capsules, designed to eliminate the above drawbacks, and which is cheap and easy to produce.

According to the present invention, there is provided a feed assembly for metering tablets into capsules, as claimed in the accompanying Claims.

BRIEF DESCRIPTION OF THE DRAWINGS

A non-limiting embodiment of the present invention will be described by way of example with reference to the accompanying drawings, in which.

BEST MODE FOR CARRYING OUT THE INVENTION

Figure 1:
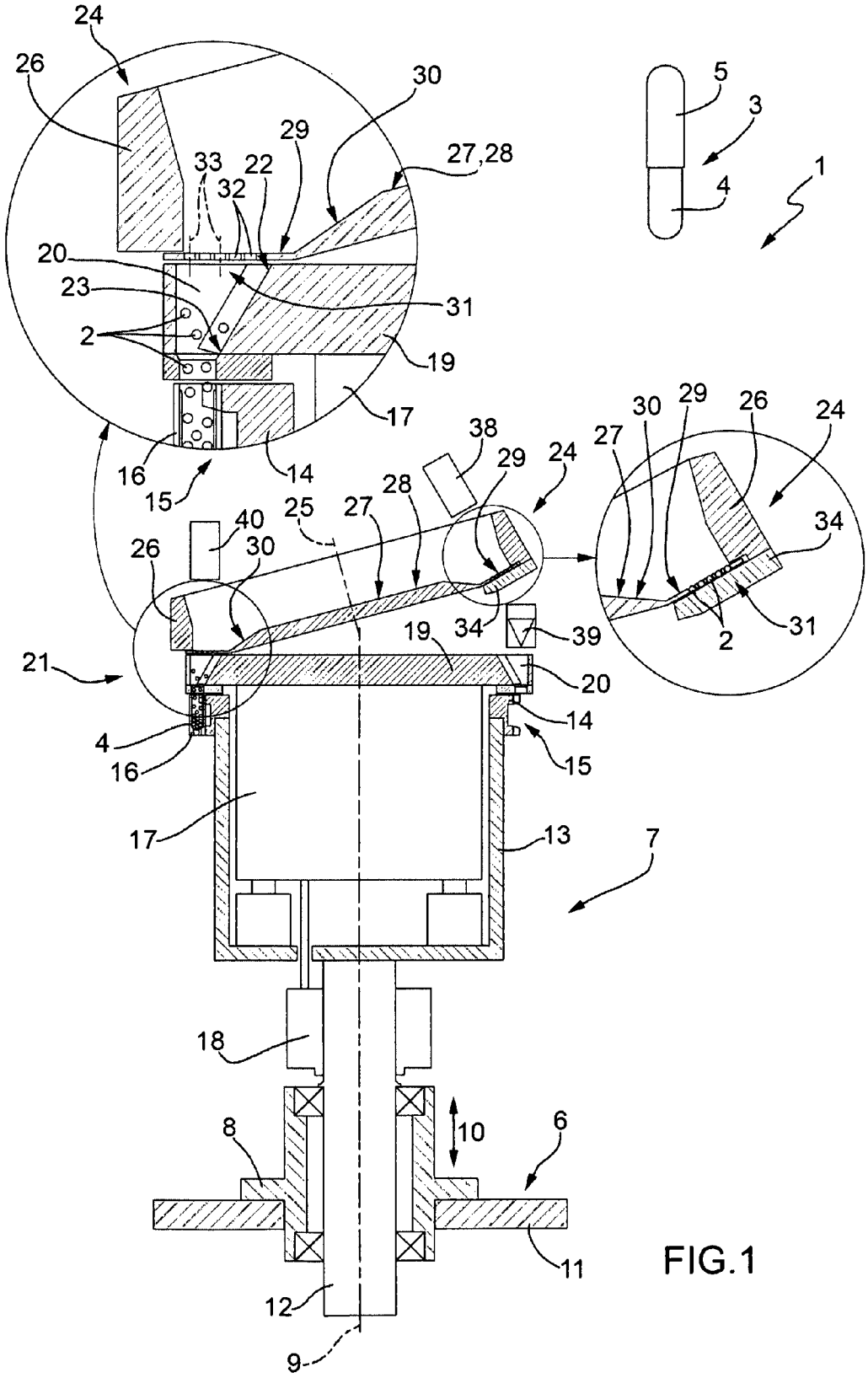
FIG. 1 shows a schematic, partly sectioned side view, with enlarged details and parts removed for clarity, of a preferred embodiment of the feed assembly according to the present invention.

Number 1 in FIG. 1 indicates as a whole a feed assembly for metering tablets 2, in particular microtablets of pharmaceutical products, into capsules 3, each of which comprises a substantially cup-shaped bottom shell 4, and a top shell 5 closing bottom shell 4.

Feed assembly 1 forms part of a machine 6 for filling capsules 3, and comprises a metering wheel 7, in turn comprising a tubular upright 8, which has a longitudinal axis 9 parallel to a substantially vertical direction 10, is fixed to a frame 11 of machine 6, and is engaged centrally and in rotary manner by a shaft 12 mounted to rotate continuously about axis 9 and with respect to frame 11 under the control of a known actuating device not shown.

A cup-shaped body 13 is fixed, coaxially with axis 9 and with its concavity facing upwards, to the top end of shaft 12, and the top end of body 13 is fitted with a sprocket 14 coaxial with axis 9 and which forms part of a pocket conveyor 15 for feeding bottom shells 4 successively along a given path.

Conveyor 15 extends endlessly about a number of sprockets (of which only sprocket 14 is shown in FIG. 1), and has a number of substantially cup-shaped, upwardly-concave pockets 16 equally spaced along conveyor 15, and each for receiving a bottom shell 4 positioned with its concavity facing upwards inside pocket 16.

Body 13 houses a vibrating base 17, which is fixed, coaxially with axis 9, to a bottom wall of body 13, is powered electrically by an annular connector 18 fitted to shaft 12, and is designed to vibrate, according to a given law, a feed disk 19 fixed to base 17, perpendicularly to axis 9, and extending over conveyor 15.

Figure 3:
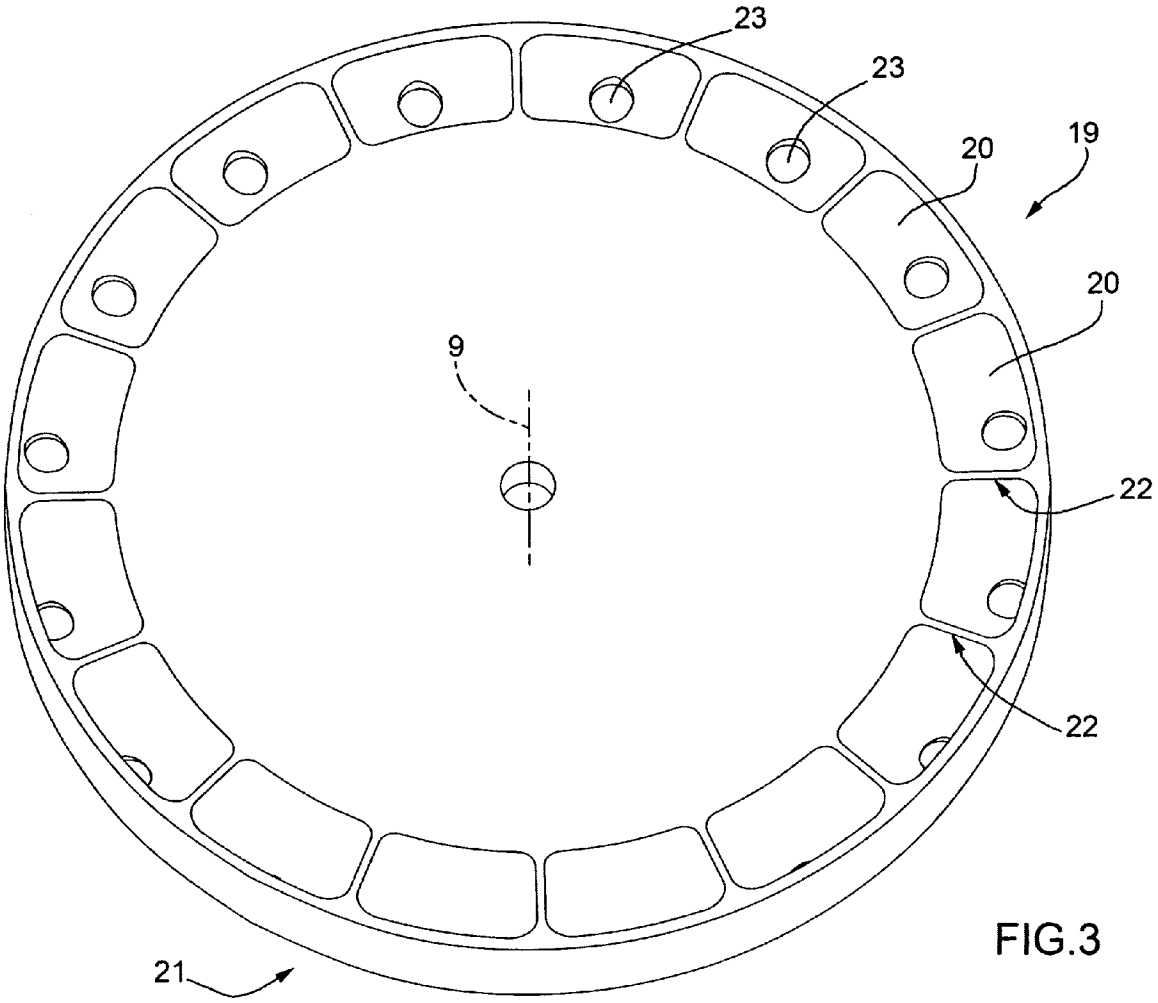
FIG. 3 shows a schematic view in perspective of a first detail of the feed assembly in FIGS. 1 and 2.

As shown in FIG. 3, disk 19 has a number of (in the example shown, sixteen) feed channels 20, which are formed along a peripheral edge of disk 19, extend through disk 19 in direction 10, are equally spaced about axis 9, and are fed by disk 19 through a metering station 21 in time with respective pockets 16 and, therefore, with respective bottom shells 4.

Each channel 20 tapers downwards, and comprises a top inlet 22 extending about axis 9; and a substantially circular bottom outlet 23 smaller in cross section than inlet 22.

Figure 4:
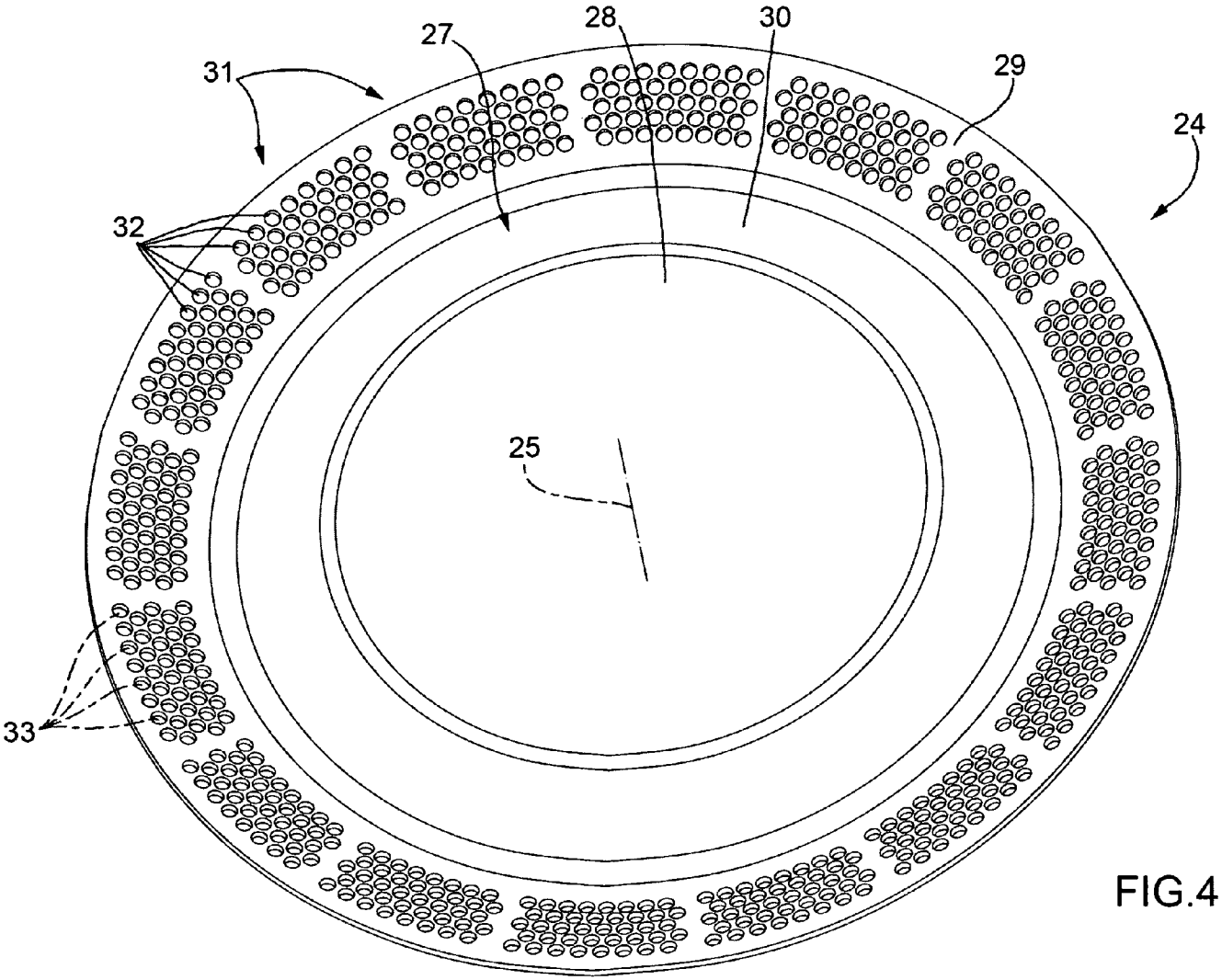
FIG. 4 shows a schematic view in perspective of a second detail of the feed assembly in FIGS. 1 and 2.

With reference to FIG. 4, feed assembly 1 also comprises a dispenser plate 24 which contains tablets 2, is mounted over disk 19 to rotate continuously, with respect to frame 11 and under the control of a known actuating device (not shown), about a longitudinal axis 25 tilted at an angle of other than 0° with respect to direction 10, is bounded radially by a lateral wall 26 fixed to frame 11 and coaxial with axis 25, and is bounded by a bottom wall 27 comprising a central portion 28 substantially perpendicular to axis 25, a substantially flat, truncated-cone-shaped, annular peripheral portion 29, and an intermediate portion 30 connecting portions 28 and 29.

In connection with the above, it should be pointed out that, at station 21, portion 29 is substantially horizontal and perpendicular to direction 10, and the distance, measured parallel to direction 10, between disk 19 and portion 29 is minimum (FIG. 1).

Portion 29 has a number of sets 31 of metering holes 32, equally spaced about axis 25, equal in number to channels 20, and which are fed by plate 24 about axis 25, each in time with a respective channel 20.

Holes 32 extend through portion 29, have respective longitudinal axes 33 substantially perpendicular to portion 29, are of a depth, measured parallel to respective axes 33, substantially equal to the height, or to a multiple of the height, of tablet 2, are each designed to receive at least one tablet 2, and are closed at the bottom by a fixed retaining plate 34, which extends about axis 25 and has an opening 35, at station 21, allowing tablets 2 to drop out of relative holes 32.

Figure 2:
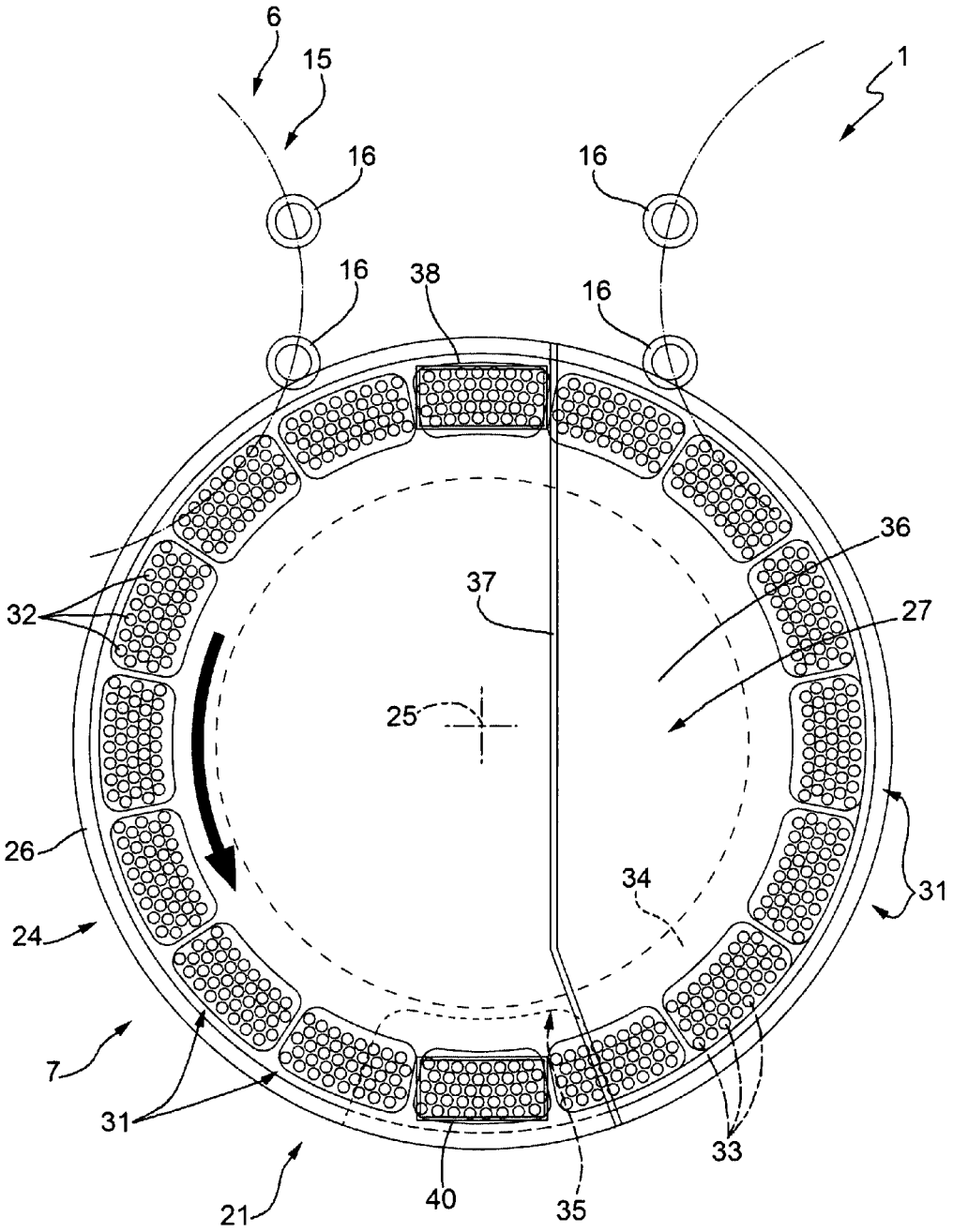
FIG. 2 shows a schematic plan view, with parts removed for clarity, of the FIG. 1 feed assembly.

In actual use, by virtue of the tilt of axis 25 with respect to direction 10, and rotation of plate 24 (anticlockwise in FIG. 2) about axis 25, tablets 2 (FIG. 2) slide:

- into a loading portion 36 of plate 24, bounded laterally by a partition 37, which extends between two points of wall 26 and inside plate 24 to prevent fallout of tablets 2 at station 21; and
- into holes 32.

In the example shown, each hole 32 houses one tablet 2, but, in variations not shown, may obviously be deep enough to house at least two tablets 2.

Upstream from the highest point of plate 24 in the rotation direction of plate 24, the loose tablets 2 drop to the bottom of plate 24 by force of gravity and the increasing slope of portion 29, so that only the tablets 2 housed inside respective holes 32 are fed forward.

At this point, sets 31 of holes 32 are fed successively downstream from partition 37 and under a first television camera 38 mounted diametrically opposite station 21 to check the presence of tablets 2 in each hole 32 of each set 31.

Each set 31 of holes 32 and relative channel 20 are then fed through station 21 in time with a relative bottom shell 4, so that the tablets 2 in holes 32 of set 31 drop through opening 35 in plate 34 into channel 20, and then into bottom shell 4.

In connection with the above, it should be pointed out that:

- vibration of disk 19 and the horizontal position of portion 29 at station 21 ensure tablets 2 drop smoothly along channels 20, to prevent channels 20 from clogging;
- the absence of tablets 2 inside channels 20 is determined by a sensor 39 located between disk 19 and plate 24, downstream from station 21 in the rotation direction of plate 24; and
- the absence of tablets 2 inside holes 32 of each set 31 is determined by a second television camera 40 mounted over plate 24, immediately downstream from station 21 in the rotation direction of plate 24.

Figure 5:
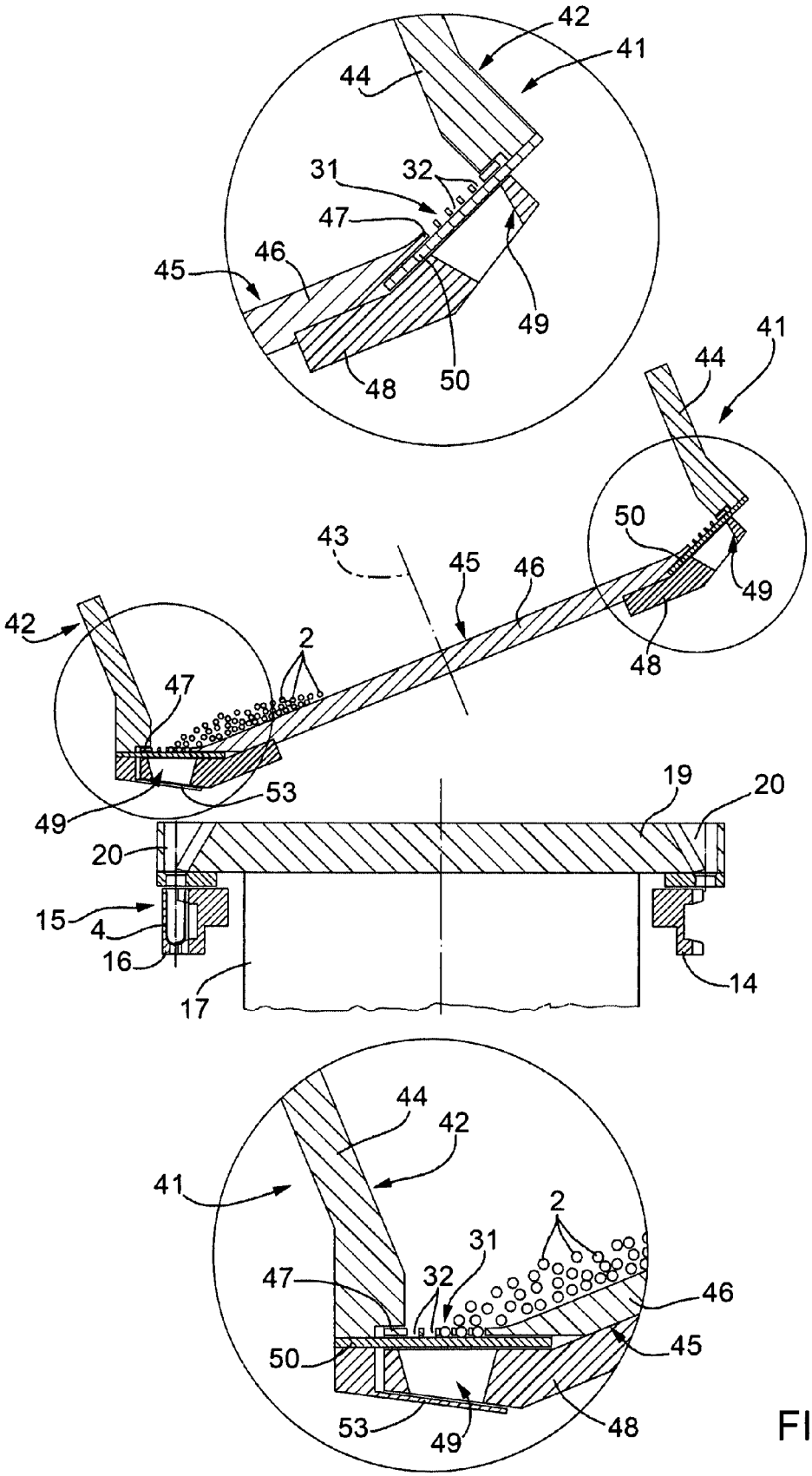
FIG. 5 shows a schematic, partly sectioned side view, with enlarged details and parts removed for clarity, of a variation of the feed assembly in FIGS. 1 and 2.
Figure 6:
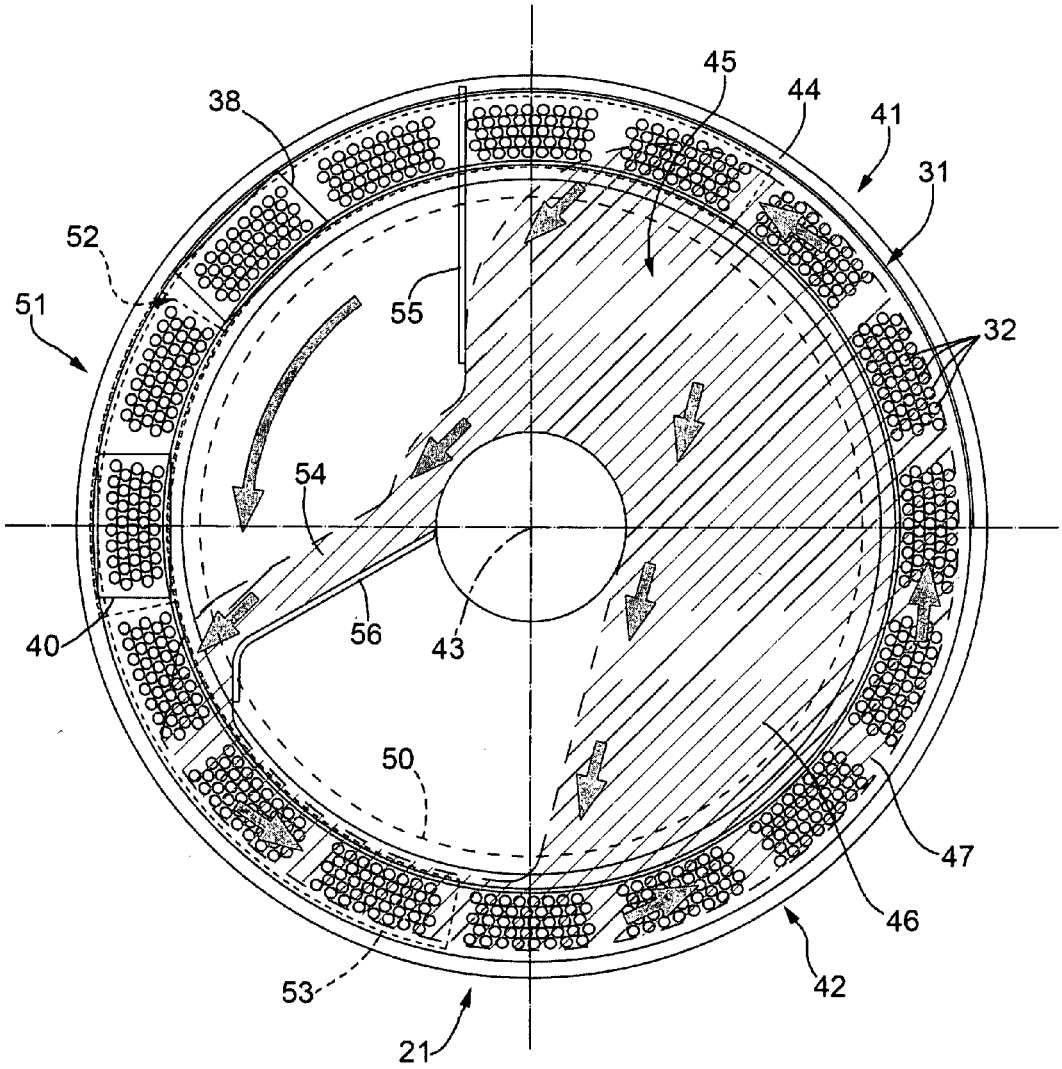
FIG. 6 shows a schematic plan view, with parts removed for clarity, of the FIG. 5 variation.
Figure 7:
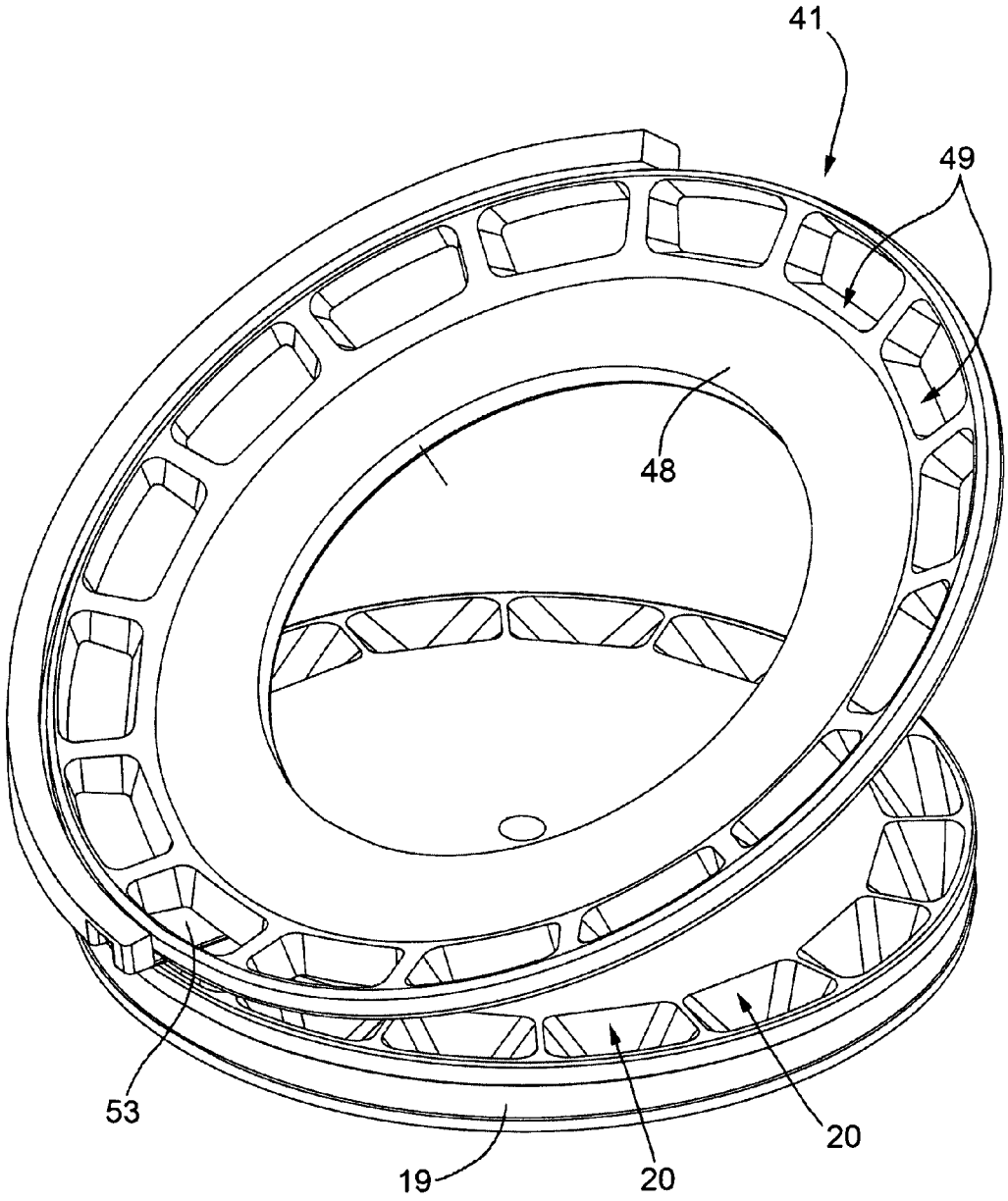
FIG. 7 shows a schematic view in perspective of a detail of the FIGS. 5 and 6 variation.

The variation in FIGS. 5, 6 and 7 differs from the FIG. 1-4 embodiment solely by dispenser plate 24 being replaced with a dispenser plate 41 comprising a top disk 42 mounted to rotate continuously, with respect to frame 11 and under the control of a known actuating device not shown, about a longitudinal axis 43 tilted at an angle of other than 0° with respect to direction 10.

Disk 42 is bounded radially by a lateral wall 44 fixed to frame 11 and coaxial with axis 43, and is bounded by a bottom wall 45 comprising a central portion 46 substantially perpendicular to axis 43, and a substantially flat, truncated-cone-shaped, annular peripheral portion 47 with sets 31 of metering holes 32.

Plate 41 also comprises a bottom disk 48, which is mounted between disks 19 and 42, coaxially with axis 43, is fitted in angularly fixed manner to disk 42, and is substantially truncated-cone-shaped so that, at station 21, it is substantially horizontal and perpendicular to direction 10, and is located the minimum distance from disk 19.

Disk 48 has a number of (in the example shown, sixteen) feed channels 49, which are formed through a peripheral edge of disk 48, are equal in number to channels 20 and sets 31 of holes 32, are equally spaced about axis 43, and each of which tapers downwards and is associated with a respective set 31 of holes 32 and a respective channel 20.

Holes 32 are closed at the bottom by a fixed retaining plate 50, which extends about axis 43, between disks 42 and 48, and comprises, at a transfer station 51 upstream from station 21 in the rotation direction of plate 41, an opening 52 allowing tablets 2 to drop from relative holes 32 into relative channels 49.

In connection with the above, it should be pointed out that, in this case, television camera 40 is mounted immediately downstream from station 51 and upstream from station 21 in the rotation direction of plate 41.

Channels 49 are closed at the bottom by a fixed retaining plate 53, which extends about axis 43, is mounted between disks 19 and 48, and extends from a point upstream from station 51, through station 51, to a point upstream from station 21 in the rotation direction of plate 41.

In actual use, by virtue of the tilt of axis 43 with respect to direction 10, and rotation of plate 41 (anticlockwise in FIG. 6) about axis 43, tablets 2 slide into a space 54 (hatched in FIG. 6) of plate 41 bounded laterally by two partitions 55, 56 mounted inside disk 42, and are loaded into relative holes 32 downstream from transfer station 51 and upstream from metering station 21 in the rotation direction of plate 41.

Upstream from the highest point of plate 41 in the rotation direction of plate 41, the loose tablets 2 drop to the bottom of disk 42 by force of gravity and the increasing slope of portion 47, so that only the tablets 2 housed inside respective holes 32 are fed forward.

At this point, sets 31 of holes 32 are fed successively beneath partition 55 to remove any tablets 2 left outside holes 32 and on disk 42, and then beneath television camera 38 to determine the presence of tablets 2 in respective holes 32.

Each set 31 of holes 32 and relative channel 49 are then fed through station 51 to allow the tablets 2 inside holes 32 of set 31 to drop through opening 52 into channel 49; and channel 49 is then fed through station 21 to allow tablets 2 to drop successively into relative channel 20 and then into relative bottom shell 4.

In connection with the above, it should be pointed out that tablets 2 are loaded into respective holes 32 upstream from station 21 in the rotation direction of plate 41, and therefore along a descending portion of the path traveled by holes 32 about axis 43. In other words, correct filling of each hole 32 is guaranteed by the fact that tablets 2 begin being loaded into respective holes 32 in an area of disk 42 where the concentration of tablets 2 is higher, and the feed speed of tablets 2 is at least partly oriented and directed the same way as the feed speed of holes 32.

The invention claimed is:

1. A feed assembly for metering tablets (2) into capsules (3), each capsule (3) comprising a bottom shell (4) and a top shell (5) closing the bottom shell (4), the feed assembly comprising a metering station (21) for metering a given number of tablets (2) into a bottom shell (4); a dispenser plate (24; 41) mounted to rotate about a longitudinal first axis (25; 43) at an angle of other than zero with respect to a substantially vertical direction (10), and having at least one set (31) of metering holes (32), each for housing at least one respective tablet (2); retaining means (34; 50, 53) located beneath the dispenser plate (24; 41) to normally prevent the tablets (2) from falling off the dispenser plate (24; 41), and which are designed to allow transfer of the tablets (2) from the dispenser plate (24; 41) into relative bottom shells (4) at the metering station (21); and a feed disk (19) which is mounted to rotate about a longitudinal second axis (9) parallel to said direction (10), and comprises, for each set (31) of metering holes (32), a respective first feed channel (20) for feeding the relative tablets (2) into a relative bottom shell (4); and the feed assembly being characterized by also comprising actuating means (17) for vibrating the feed disk (19).

2. A feed assembly as claimed in claim 1, wherein the dispenser plate (24; 41) comprises a number of said sets (31) of metering holes (32); and the feed disk (19) comprises a respective said first feed channel (20) for each set (31) of metering holes (32).

3. A feed assembly as claimed in claim 1, and also comprising an actuating device for moving the dispenser plate (24; 41) and the feed disk (19) continuously about said first and second axis (25, 9) respectively.

4. A feed assembly as claimed in claim 1, wherein the dispenser plate (24; 41) is bounded radially by a fixed lateral wall (26; 44).

5. A feed assembly as claimed in claim 1, wherein the distance, measured parallel to said direction (10), between the dispenser plate (24; 41) and the feed disk (19) is minimum at the metering station (21).

6. A feed assembly as claimed in claim 1, and also comprising a first control device (39) for determining the absence of tablets (2) in each first feed channel (20).

7. A feed assembly as claimed in claim 1, and also comprising a second control device (38), located upstream from the metering station (21) in the rotation direction of the dispenser plate (24; 41), to determine the presence of tablets (2) in each metering hole (32).

8. A feed assembly as claimed in Cairn 1, wherein each first feed channel (20) has an net (22) for receiving the tablets (2) from the metering holes (32) in the relative set (31) of metering holes (32), and an outlet (23) for the tablets (2); the net (22) being larger in cross section than the outlet (23).

9. A feed assembly as claimed in claim 1, wherein the dispenser plate (24; 41) is bounded by a bottom wall (27; 45) comprising an annular portion (29; 47) through which the metering holes (32) are formed; the annular portion (29; 47) being substantially truncated-cone-shaped.

10. A feed assembly as claimed in claim 9, wherein each metering hole (32) has a longitudinal third axis (33) substantially perpendicular to said annular portion (29; 47).

11. A feed assembly as claimed in claim 9, wherein the annular portion (29) is substantially horizontal and perpendicular to said direction (10) at the metering station (21).

12. A feed assembly as claimed in claim 1, wherein the dispenser plate (24; 41) comprises a loading area (36; 54) where the tablets (2) are loaded into the metering holes (32); and a partition (37; 55, 56) fixed inside the dispenser plate (24; 41) to laterally define, and keep the tablets (2) inside, the loading area (36; 54).

13. A feed assembly as claimed in claim 1, and also comprising a third control device located downstream from the metering station (21) in the rotation direction of the dispenser plate (24), to determine the absence of tablets (2) in each metering hole (32).

14. A feed assembly as claimed in claim 1, wherein the dispenser plate (41) comprises a first disk (42) having said sets (31) of metering holes (32); and a second disk (48) which is fitted in angularly fixed manner to the first disk (42) to rotate about said first axis (43), is located between the first disk (42) and the feed disk (19), and comprises, for each set (31) of metering holes (32), a respective second feed channel (49) for transferring the relative tablets (2) from the relative metering holes (32) into a relative said first feed channel (20).

15. A feed assembly as claimed in claim 14, wherein the retaining means (34; 50, 53) comprise first retaining means (50) located between the first and second disk (42, 48) to normally close the metering holes (32), and which are designed to open the metering holes (32) upstream from the metering station (21) in the rotation direction of the dispenser plate (41); and second retaining means (53) located beneath the second disk (48) to normally dose said second feed channels (49), and which are designed to open the second feed channels (49) at the metering station (21).

16. A feed assembly as claimed in claim 14, and also comprising a fourth control device located downstream from a transfer station (51) for transferring the tablets (2) from the relative metering holes (32) into the relative second feed channels (49), and upstream from the metering station (21) in the rotation direction of the dispenser plate (41), to determine the absence of tablets (2) in each metering hole (32).

* * * * *